US009003563B2

(12) United States Patent
Mackintosh

(10) Patent No.: US 9,003,563 B2
(45) Date of Patent: Apr. 14, 2015

(54) PROTECTIVE CLOTHING

(75) Inventor: Grant Charles Mackintosh, Port Melbourne (AU)

(73) Assignee: Becon Pty Ltd, Victoria (AU)

( * ) Notice: Subject to any disclaimer, the term of this patent is extended or adjusted under 35 U.S.C. 154(b) by 611 days.

(21) Appl. No.: 12/734,433

(22) PCT Filed: Oct. 31, 2008

(86) PCT No.: PCT/AU2008/001600

§ 371 (c)(1),
(2), (4) Date: Aug. 30, 2010

(87) PCT Pub. No.: WO2009/055850

PCT Pub. Date: May 7, 2009

(65) Prior Publication Data

US 2010/0325766 A1 Dec. 30, 2010

(30) Foreign Application Priority Data

Oct. 31, 2007 (AU) ..... 2007905973
Aug. 29, 2008 (AU) ..... 2008904480

(51) Int. Cl.
*A41D 13/00* (2006.01)
*A41D 27/02* (2006.01)
*A41D 31/00* (2006.01)

(52) U.S. Cl.
CPC ..... *A41D 13/00* (2013.01); *A41D 27/02* (2013.01); *A41D 31/0055* (2013.01); *A41D 2600/102* (2013.01)

(58) Field of Classification Search
CPC . A41D 13/00; A41D 2600/102; A41D 27/02; A41D 31/0055
USPC ..... 2/22, 23, 272, 228, 455, 267, 242, 24, 2/81, 80
See application file for complete search history.

(56) References Cited

U.S. PATENT DOCUMENTS

| | | | | | |
|---|---|---|---|---|---|
| 2,263,546 | A | * | 11/1941 | Goldsmith et al. | 2/227 |
| 4,282,608 | A | * | 8/1981 | Amberg | 2/227 |
| 4,987,613 | A | * | 1/1991 | Loverdi et al. | 2/23 |
| 5,267,354 | A | * | 12/1993 | Grilliot et al. | 2/23 |
| 5,572,737 | A | * | 11/1996 | Valice | 2/465 |
| 5,649,328 | A | * | 7/1997 | Martin | 2/238 |
| 5,664,256 | A | * | 9/1997 | Blauer et al. | 2/69 |
| 5,918,319 | A | * | 7/1999 | Baxter | 2/455 |
| 6,041,437 | A | * | 3/2000 | Barker et al. | 2/82 |

(Continued)

FOREIGN PATENT DOCUMENTS

AU 199963148 A1 * 6/2000

*Primary Examiner* — Khoa Huynh
*Assistant Examiner* — Anna Kinsaul
(74) *Attorney, Agent, or Firm* — K&L Gates LLP

(57) ABSTRACT

An article of protective clothing for use by a motorcyclist, or the like, including an abrasion resistant material is provided. The abrasion resistant material is attached to an inner surface of the clothing by being sewn along at least one inside seam away from a waist portion of the clothing so as to limit the outward modification of an otherwise normal garment to a casual observer while still providing protection to the motorcyclist. The article of clothing is relatively indistinguishable from regular clothing. The article of clothing includes a pair of trousers with an inner protective abrasion resistant panel, which extends across a knee area and then up the side of the clothing along a thigh area to a hip and then around a bottom area to then return down the side of the other leg to the portion extending around the knee area.

3 Claims, 5 Drawing Sheets

FRONT

(56) References Cited

U.S. PATENT DOCUMENTS

Figure 1C:
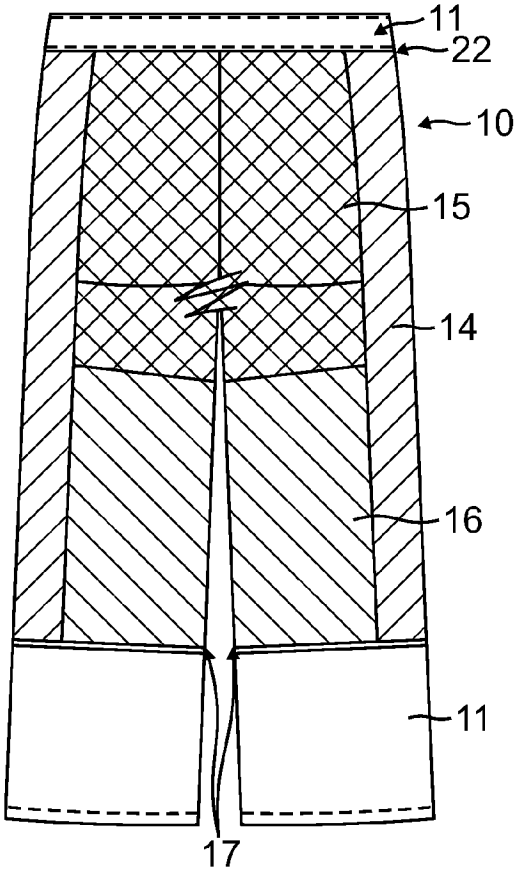

| | | | | |
|---|---|---|---|---|
| 6,041,447 | A * | 3/2000 | Endler | 2/455 |
| 6,968,573 | B2 * | 11/2005 | Silver | 2/227 |
| 7,013,489 | B1 * | 3/2006 | McGrath | 2/69 |
| 7,849,522 | B2 * | 12/2010 | Roux | 2/227 |
| 8,256,034 | B2 * | 9/2012 | Berner et al. | 2/455 |
| 2011/0289644 | A1 * | 12/2011 | Beshlian | 2/46 |
| 2012/0005797 | A1 * | 1/2012 | Cotsoglou et al. | 2/16 |
| 2012/0324618 | A1 * | 12/2012 | Dieffenbacher | 2/93 |

* cited by examiner

BACK

SIDE

FRONT

BACK

FRONT

PROTECTIVE CLOTHING

This application is a U.S. National Phase of PCT/AU2008/001600, filed on Oct. 31, 2008, which claims priority to Australian Patent Application No. 2008904480, filed on Aug. 29, 2008, and to Australian Patent Application No. 2007905973, filed on Oct. 31, 2007, the content of which is expressly incorporated herein by reference thereto.

BACKGROUND

This invention relates to protective clothing and in particular to clothing of a type used by motorcyclists. In this context, it is to be understood that the protective clothing also could be used by motor scooter riders and those involved in similar activities.

It is conventional for motorcyclists to wear leather clothing, which is good for abrasion resistance and for protection of the rider from the wind and other elements.

Clothing made from leather, however, is often not appropriate from a fashion, business or social point of view or may be considered inappropriate in some instances where a different style of clothing might be considered more appropriate.

Thus, leather clothing is not always appropriate for use in many environments, so that the motorcyclist has to consider having a change of clothing from when riding the motorcycle to when attending a social or business function.

It has been known to use protective shields in the manner for instance of leggings or chaps, which are either supported externally to the clothing or are secured to an external surface of the clothing.

The problem with this arrangement is again the problem that the clothing still takes the appearance of clothing intended for motorcycle riding and not for attendance at social or business functions or for general day-to-day activities.

Such external shields can however be made from materials such as polycarbonate which will provide excellent abrasion protection, but the difficulty is that they must also be comfortable to use and from a commercial point of view, shapes must be found that are appropriate for at least a reasonable range of different sizes of people who might use these.

These problems have been overcome partially by providing clothing having patches of protective material constructed or sewn into the inner-side of the garments. Such patches are disclosed in AU769691 to the present applicant filed 3 Dec. 1999. The present inventors have however realised that, to some extent, there are obvious clues (such as stitching across the fabric in areas where stitches would not otherwise be placed) that indicate that the otherwise normal garments have been modified as motorcycle protective clothing.

It would accordingly be advantageous to provide the public with a useful alternative to existing motorcyclist type clothing which will be better accepted in a business or social situation to motorcyclists and the like and yet still provide good protection.

There is a current market for this type of protection, but it still has the above-mentioned difficulties.

SUMMARY OF THE INVENTION

According to a first aspect of preferred arrangements herein described there is provided a article of protective clothing for a motorcyclist, or the like, with placement of a substantially abrasion resistant material at locations which are chosen to provide protection for the motorcyclist in the event of most situations where the rider will be caused to be sliding along the ground, wherein the abrasion resistant material is attached to an inner surface of the clothing by being sewn along at least one inside seam away from a waist portion of the clothing so as to limit the outward modification of an otherwise normal garment to a casual observer, while still providing protection in the event of most situations where the rider is caused to be sliding along the ground.

Preferably the stitching of the abrasive resistant material to the at least one inside seam does not extend to the outer surface of the article of clothing.

Preferably the abrasion resistant material is contained in a breathable sports-type comfort lining that provides extra protection. With the abrasion resistant material located between the clothing and the breathable sports-type comfort lining relatively improved breathability is provided. In addition the inner lining advantageously limits the potential for abrasion injury from the inside of the garment by minimizing shear force interception.

Preferably the abrasion resistant material is first over-locked together with a breathable lining and then the breathable lining and abrasion resistant material are sewn to the at least one inside seam adjacent the over-locking with the breathable lining providing a further layer of protection and the abrasion resistant material being located between the inner breathable lining and the outer clothing. Safety stitching is preferably added to the abrasion resistant material and breathable lining before they are sewn to the at least one inside seam.

Preferably the abrasion resistant material and breathable lining are also sewn to the waist portion of the clothing. The waist portion may comprise the waist portion of a pair of trousers or the waist portion of a jacket.

The article of clothing preferably comprises a pair of trousers having an inner protective abrasion resistant panel which extends across a knee area and then up the side of the clothing along the thigh area to the waist and then around the bottom area to then return down the side of the other leg to the portion extending around the knee with the at least one seam extending along the length of the trousers. This provides for abrasion resistant protection in the event that the rider is going to slide on his or her bottom, be caused to slide on one or other side or be caused to slide on the face insofar that the knees project and are appropriately protected.

As noted the abrasion resistant material is attached on the inside surface of the clothing. The abrasion resistant material preferably comprises a knitted or woven material that is highly abrasion resistant. Preferably, the abrasion resistant material also is both tear and burst resistant.

By attaching the abrasive resistant material on the inside of the clothing, this removes the difficulty associated with the appearance of the clothing because the protection itself is on the inside and not outside of the clothing itself and therefore generally invisible to the casual observer. Furthermore having the abrasive material attached to an inner surface of the clothing by being sewn along at least one inside seam away from a waist portion of the clothing, it is possible to limit the outward modification of an otherwise normal garment to a casual observer while still providing protection in the event the rider is caused to be sliding along the ground.

By having the material comprised of interlaced (either by way of weaving or knitting) strands of highly abrasion resistant (and/or tear resistant and/or burst resistant) material (as disclosed in AU769691), means that the advantage of the protection at least from abrasion is available and yet the material itself is much more likely to conform easily to the shape appropriate for the user during various modes of use. This has resulted in providing both comfort, adequate protection from abrasion in the case of an accident, and an appearance that is more suitable for wear other than when riding the vehicle.

Hitherto, the location of protective shielding has, in some cases, been chosen from the point of view of minimising damage to the clothing itself, firstly because it has been located externally from the clothing, and secondly, hard sheets of material often are unpleasant to wear, so that a wearer would not wish to extend its use unnecessarily. By discovering a material that can be used on the inside of clothing, and further can be comfortably worn, the focus can turn not so much to protection of clothing, but to protection of the user of the clothing. Ideally, the garment would be capable of normal domestic laundry and drying processes.

DETAILED DESCRIPTION OF THE INVENTION

For a better understanding of this invention it will now be described with the assistance of figures.

Figure 1B:
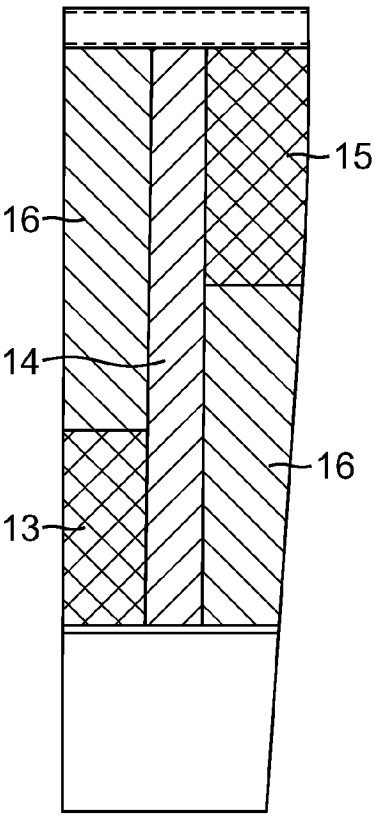
Figure 1A:
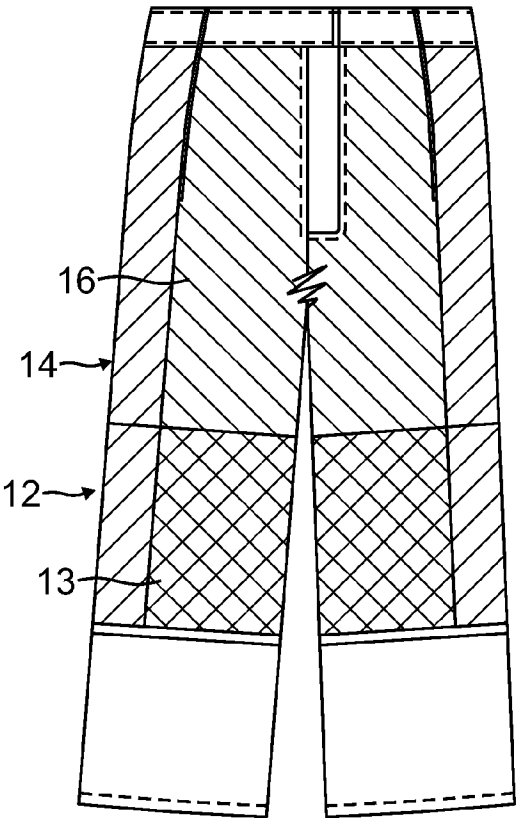

FIGS. 1*a*, 1*b* and 1*c* are plan views of an arrangement in accord with an embodiment of the invention showing the inner-side of trousers from the front, side and back, respectively.

Figure 2B:
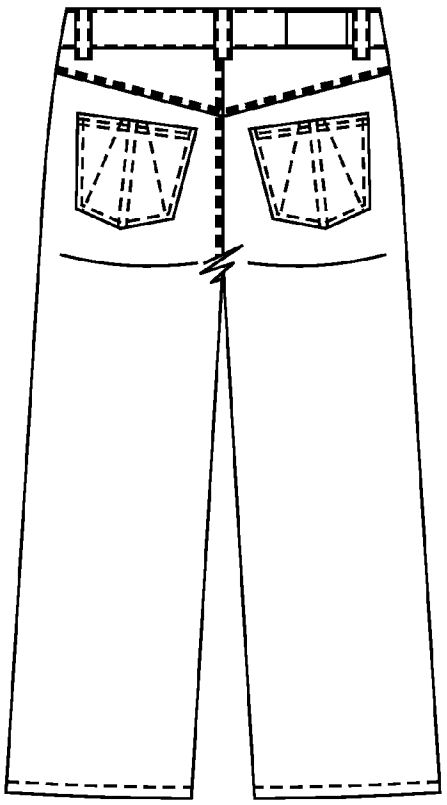
Figure 2A:
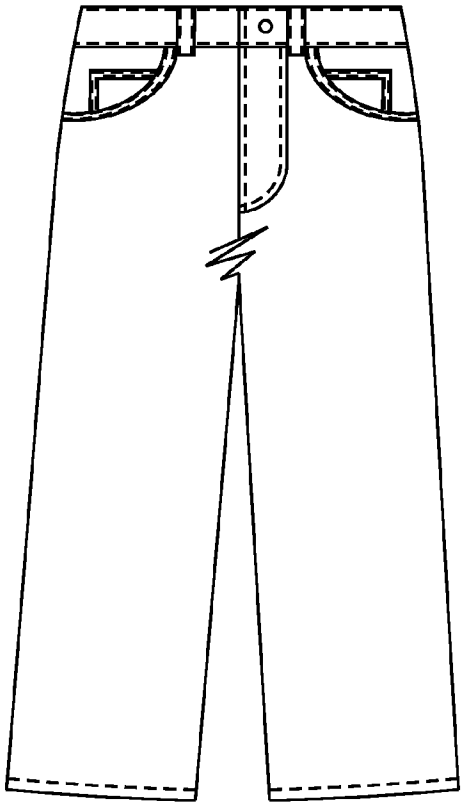

FIGS. 2*a* and 2*b* are plan views of the outer-side of the trousers shown in FIG. 1 from the front and back, respectively.

Figure 3C:
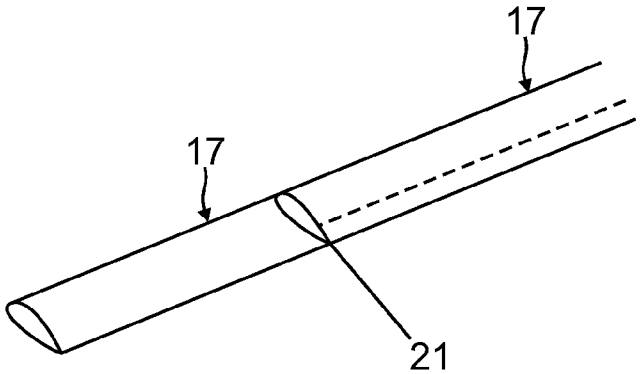
Figure 3B:
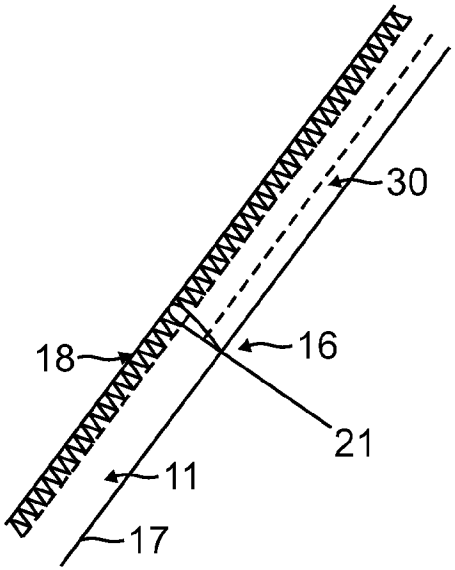
Figure 3A:
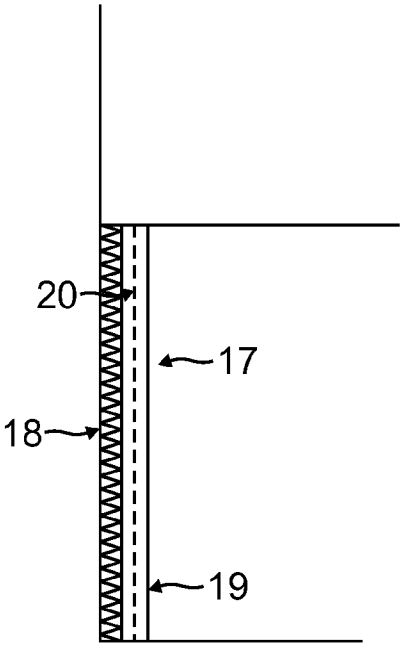

FIGS. 3*a*, 3*b* and 3*c* are enlarged views of the stitching of the fabric at the inner seam of the garment shown in FIG. 1.

Figure 4B:
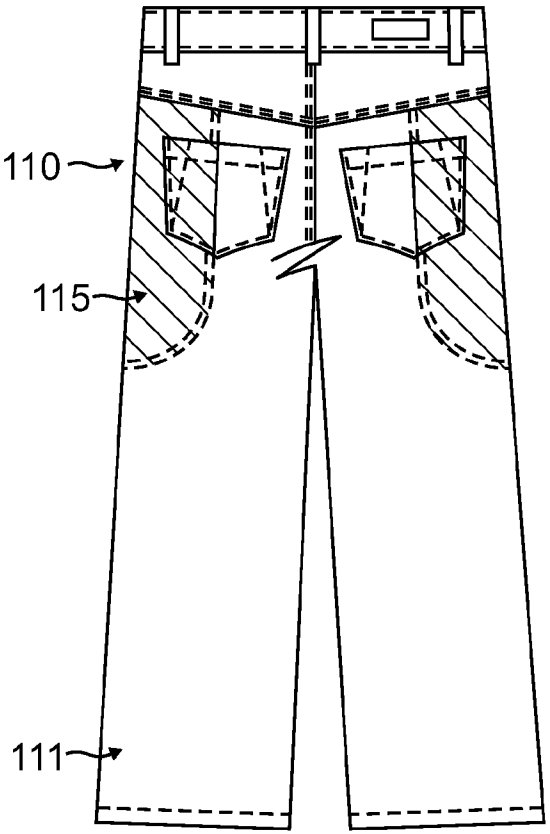
Figure 4A:
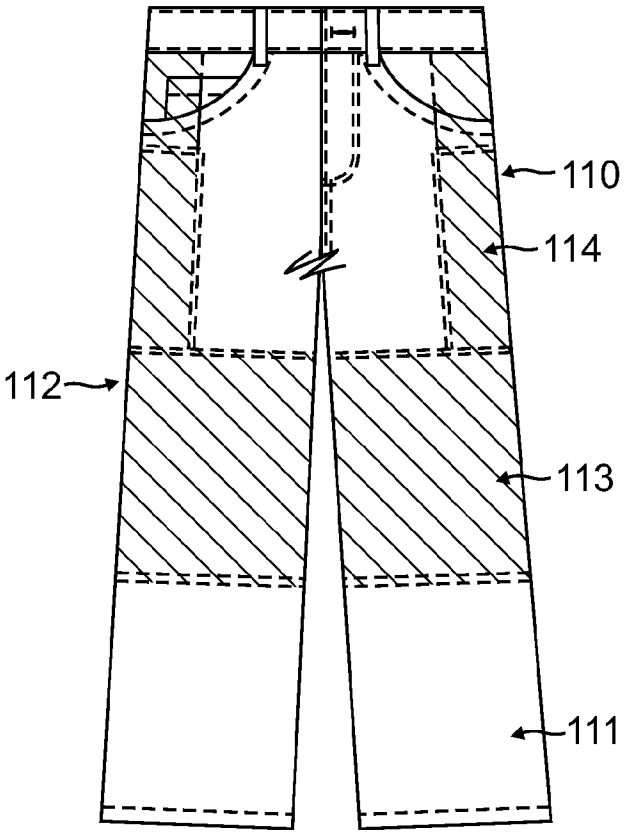

FIGS. 4*a* and 4*b* are plan views of another arrangement in accord with an embodiment of the invention showing the inner-side of trousers from the front and back, respectively.

Figure 5B:
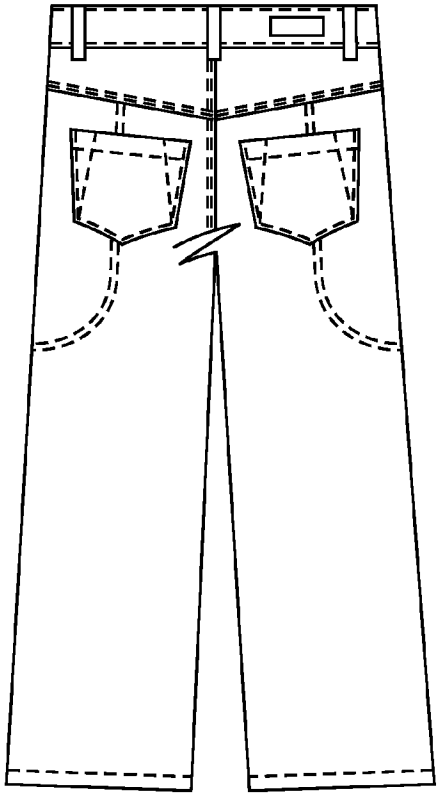
Figure 5A:
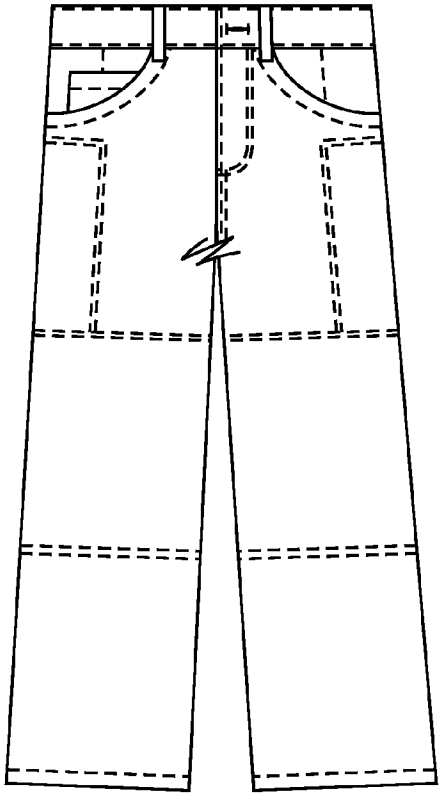

FIGS. 5*a* and 5*b* are plan views of the outer-side of the trousers shown in FIGS 4*a* and 4*b* from the front and back, respectively.

Referring in detail to the figures, in particular to FIG. 1, this depicts a piece of protective clothing according to the present invention, namely trousers 10 of conventional attire. In the embodiment, the external fabric is denim.

The trousers 10 include a panel of an abrasion resistant material 12 affixed to the inner face of the denim material 11 from which the trousers 10 are formed.

This abrasion resistant material is comprised of knitted strands of highly abrasion resistant, tear resistant and burst resistant material.

The panel 12 is comprised of three functional parts, a first being a panel across the knees at 13, a panel which extends from the knee area to the waist along the thigh area at 14 and a panel that extends around the bottom at 15.

In this way then, the substantially abrasion resistant material is located at parts conventionally covered by trousers, which would be most vulnerable to abrasion in the event of an accident.

A lining 16 of a breathable sports-type material over the panel 12 provides extra protection and comfort for the wearer. Preferably, the lining 16 extends from the inner side of the legs and is attached by stitching to the panel 12 but does not extend across the thigh functional part 14.

The abrasion resistant material of the panel 12 and the lining 16 are secured by appropriate stitching to the inside seam 17 of the fabric providing the clothing, as shown in FIG. 3.

FIG. 3*a* depicts a plan view, from the side, of the seam 17. Overlocking 18 secures the edge of the lining 16 to the edge of the panel 12. A safety stitch 19 is included for added strength and then the seam is constructed by a line of stitching 20 through the denim 11 of the clothing, the panel 12 and the lining 16.

FIGS. 3*b* and 3*c* further illustrate the arrangement of the liner 16, the seam 17, the hem 21 of the liner and the fabric 11 of the trousers 10.

The lining 16 is also attached to the waistband 22 of the trousers 10 by conventional stitching, as is known in the art. The panel 12 is also attached along its edges to the liner 16 by conventional stitching.

By this means of attachment of the panel 12 to the lining 16 and the attachment of that combined structure to the trousers 10 through the seam 17 and waistband 22, no stitching is visible in the outer surface of the clothing. (As illustrated by the views of the trousers 10 in FIG. 2.)

Additional impact protection (not shown) may be provided by attaching suitable armour to the knee area and/or in pockets, or the like, in the hip area.

An alternative embodiment is depicted in FIGS. 4*a*, 4*b*, 5*a* and 5*b*, which depict another piece of protective clothing according to the present invention, namely trousers 110 of conventional attire. In the embodiment, the external fabric is denim.

The trousers 110 include a panel of an abrasion resistant material 112 affixed to the inner face of the denim material 111 from which the trousers 110 are formed.

This abrasion resistant material is comprised of knitted strands of highly abrasion resistant, tear resistant and burst resistant material.

In a similar fashion to the previously described example, the panel 112 is comprised of three functional parts, a first being a panel across the knees at 113, a panel which extends from the knee area to the waist along the thigh area at 114. In this embodiment, there is no panel that extends around the bottom as compared with the panel 15 of the previous example (shown in FIGS. 1*b* and 1*c*). Rather, panel 115 extends only partially centrally towards the bottom and extends further down the thigh than panel 15.

Now referring to the abrasion resistant material, it has been found that there are materials which can be formed together to form multiple strands in the manner of fibres such as wool but which none the less exhibit very high abrasion resistance. One such fibre is aramid and a material has been knitted from this and forms the panels described in FIG. 1.

In a further form, the material chosen could include a synthetic fiber, such as KEVLAR®, but has in addition included other materials to assist in other characteristics, firstly to provide for resilience and a feeling of softness when being worn. One such material is sold under the trademark KEPROTEC®. Such a material is formed by a mixture of synthetic fibers, synthetic polymers, polyethylene fibers and/or other similar materials, such as those sold under the trademarks KEVLAR®, TWARON®, LYCRA®, NYLON® and DYNEEMA®.

A preferred material is a multi fibre terry knit fabric comprising a synthetic fiber, such as KEVLAR®, and a blend of a synthetic fiber, such as KEVLAR®, a polyethylene fiber, such as DYNEEMA®, and polyester.

Preferably, this abrasion resistant material is knitted with an open weave or knit, which thereby creates a porous assembly that also provides ridges and gullies along the length of the material to assist in ensuring that there is adequate air in the vicinity of any strand and therefore assists in keeping this cool in the extreme circumstances of providing substantial abrasion resistance.

The preferred material for the sports comfort liner is MICROMESH®, which is 100% micro-polyester of around 160 gsm. MICROMESH® is effective for moisture management and has a high "breathability". However, it has an added benefit in its capacity to limit potential abrasion injury from the inside of the garment by minimizing "shear force interception", commonly known as "carpet burn".

The claims defining the invention are as follows:

1. Trousers, comprising:

an outer fabric layer comprising a waistband and a pair of legs, each leg having at least one inside seam, a knee portion, and a distal end opposite the waistband, wherein the outer fabric layer comprises a denim fabric;

an inner fabric layer comprising a pair of legs, each leg having a front portion to cover an upper front portion of a leg of a wearer, a side portion to cover at least a portion of a thigh of the wearer, an upper rear portion to cover at least a portion of a buttocks region of the wearer, a lower rear portion to cover at least a portion of a back of the wearer's leg below the buttocks region, and an inner layer knee portion;

wherein the inner layer knee, side, and upper rear portions of each inner fabric layer leg comprise an abrasion resistant fabric and the front portion and lower rear portion of each inner fabric layer leg comprise mesh fabric;

wherein the abrasion resistant and mesh fabrics are different fabrics attached to each other forming the inner fabric layer;

wherein the inner fabric layer is attached to the outer fabric layer at the waistband; and wherein the inner fabric layer is further attached to the outer fabric layer at the at least one inside seam of each leg below the knee portion and above the distal end.

2. The trousers of claim 1, wherein the abrasion resistant fabric comprises an aramid fabric.

3. The trousers of claim 1, wherein the mesh fabric comprises a polyester micromesh fabric.

* * * * *